US008181497B2

(12) United States Patent
Zaloudek

(10) Patent No.: US 8,181,497 B2
(45) Date of Patent: May 22, 2012

(54) POST STRAIGHTENING APPARATUS AND METHOD

(75) Inventor: Mark Zaloudek, Kremlin, OK (US)

(73) Assignee: Double Z Enterprises, LLC, Kremlin, OK (US)

( * ) Notice: Subject to any disclaimer, the term of this patent is extended or adjusted under 35 U.S.C. 154(b) by 0 days.

(21) Appl. No.: 13/008,858

(22) Filed: Jan. 18, 2011

(65) Prior Publication Data

US 2011/0094284 A1 Apr. 28, 2011

(51) Int. Cl.
*B21C 51/00* (2006.01)

(52) U.S. Cl. ..... 72/31.03; 72/308; 72/457; 72/705

(58) Field of Classification Search ..... 72/293, 72/295, 296, 316, 318, 386, 389.1, 446, 447, 72/457, 705, 31.02, 31.03, 299, 304, 305, 72/308

See application file for complete search history.

(56) References Cited

U.S. PATENT DOCUMENTS

| | | | | |
|---|---|---|---|---|
| 1,426,658 | A * | 8/1922 | McGuckin | 33/567 |
| 1,700,748 | A * | 2/1929 | Schaaf | 72/31.02 |
| 1,907,925 | A * | 5/1933 | Wochner | 72/389.7 |
| 2,141,736 | A * | 12/1938 | Castle et al. | 72/414 |
| 2,180,157 | A * | 11/1939 | Loftus | 72/373 |
| 2,393,317 | A * | 1/1946 | Edwards, Jr. et al. | 72/293 |
| 2,490,976 | A * | 12/1949 | Mayne et al. | 29/889.6 |
| 2,596,976 | A | 5/1952 | Barber | |
| 2,788,831 | A * | 4/1957 | Weiner | 72/415 |
| 3,108,629 | A * | 10/1963 | Jenkins | 72/457 |
| 3,220,240 | A * | 11/1965 | Selvaggio | 72/404 |
| 3,400,567 | A * | 9/1968 | Sirantoine | 72/299 |
| 3,501,941 | A | 3/1970 | Long | |
| 3,623,350 | A * | 11/1971 | Wochner | 72/362 |
| 3,779,295 | A | 12/1973 | Balsbaugh | |
| 4,055,981 | A | 11/1977 | Olson | |
| 4,088,002 | A * | 5/1978 | Andrew | 72/389.6 |
| 4,254,651 | A | 3/1981 | Kelly | |
| 4,400,968 | A * | 8/1983 | Barbieri | 72/457 |

(Continued)

FOREIGN PATENT DOCUMENTS

CN 201217024 Y 4/2009

(Continued)

OTHER PUBLICATIONS

MDOT, Schedule C Equipment Rental Rates, Michigan Department of Transportation, Jan. 1, 2010, http://www.michigan.gov/documents/mdot/MDOT_Rental_2009_Report_375_259913_7.pdf.

*Primary Examiner* — Edward Tolan
(74) *Attorney, Agent, or Firm* — Matthew S. Gibson; Sasha L. Legere; McAfee & TAft

(57) ABSTRACT

An apparatus and method for straightening an article are disclosed. The apparatus and method disclosed provide for the conservation of metal, reduction waste worldwide, and the extension of the useful life for an article. The apparatus may comprise an actuator, an endpiece coupled to the actuator, the endpiece including two arms, the arms defining a space therebetween; and a support member including two rails, the rails defining a space therebetween. Upon activation of the actuator, the arms engage the article disposed on the rails. Also, the space between the arms is aligned with the space between the rails. Both spaces are adapted to receive article portions such that portions within the spaces are not engaged by the arms.

9 Claims, 6 Drawing Sheets

U.S. PATENT DOCUMENTS

| | | | | |
|---|---|---|---|---|
| 4,483,175 | A | 11/1984 | Hansen | |
| 4,534,197 | A | 8/1985 | Woolley | |
| 4,558,583 | A | 12/1985 | Shaw, Sr. et al. | |
| 4,862,724 | A | 9/1989 | Haws | |
| 4,974,436 | A | 12/1990 | Nakatsuji | |
| 5,406,821 | A | 4/1995 | Sabine et al. | |
| 5,878,615 | A | 3/1999 | Brown | |
| 5,904,340 | A * | 5/1999 | Allamon | 254/93 H |
| 6,272,900 | B1 * | 8/2001 | Kobel | 72/392 |
| 6,318,424 | B1 | 11/2001 | Elfrink | |
| 6,823,707 | B2 * | 11/2004 | Andras et al. | 72/389.1 |
| 7,302,824 | B1 * | 12/2007 | Buckler et al. | 72/447 |

FOREIGN PATENT DOCUMENTS

| | | | |
|---|---|---|---|
| DE | 19924408 | A1 | 1/2001 |
| EP | 1 093 867 | A2 | 4/2001 |
| GB | 25472 | | 12/1902 |
| JP | 63199025 | A | 8/1988 |

* cited by examiner

POST STRAIGHTENING APPARATUS AND METHOD

BACKGROUND

The inability to quickly and effectively straighten a bent metal article contributes to the proliferation of metal waste in landfills around the world.

For example, metal articles are used in fence lines as well as support posts for signs. In maintaining fence lines, the property owner travels along the fence line to inspect the integrity of the fence. Upon finding a bent article, the property owner typically discards the article and replaces the article with a new unbent replacement in lieu of the physically-intensive and time-intensive manual straightening of the article, and the cost-intensive option of transporting and repairing the article at a separate location.

The prior art does not describe an apparatus or method that quickly and effectively straightens a metal article containing ridges or other variable surfaces. An apparatus or method of this type would contribute to the reduction of metal waste in the world's landfills.

SUMMARY

The apparatus and method described herein provide a portable implement that can be used on-site to quickly and effectively straighten a metal article thereby extending the useful life of the article, conserving metal and fuel, reducing transportation costs, reducing costs associated with the destruction of property, as well as stymie the growth of metal waste in landfills worldwide. Embodiments of the inventive apparatus could be used in a variety of applications, including the farming and livestock industries, as the costs with maintaining fencing lines are significant.

In one embodiment, an apparatus for straightening an article is provided. The apparatus comprises an actuator; an endpiece coupled to the actuator, the endpiece including two arms, the arms defining a space therebetween; a support member, the support member including two rails, the rails defining a space therebetween. Upon activation of the actuator, the arms will engage article portions disposed on the rails to straighten the article. The spaces defined between the arms and the rails are adapted to receive article portions to prevent contact with such portions if desired.

In another embodiment, an apparatus for straightening an article comprises an actuator; an endpiece coupled to the actuator, the endpiece including two arms, the arms defining a space therebetween, and the arms also define arm contact surfaces for contacting the article. The apparatus also includes a support member including two rails, the rails defining a space therebetween, and the rails also define rail contact surfaces for supporting the article. Also included is an elongated frame member, such that the actuator and the support member are coupled to the frame member and arranged such that the space between the arms is aligned with the space between the rails. Upon activation of the actuator, the actuator moves toward the support member causing the arm contact surfaces of the arms to engage the article. The space between the arms is adapted to receive article portions adjacent to those engaged by the arms and the space between the rails is adapted to receive article portions such that article portions within the spaces are not engaged.

In another embodiment, a method for straightening an article is disclosed. The method comprises the steps of: (a) placing an article on a pair of rails, the rails defining a first space therebetween; (b) moving an actuator with a pair of arms connected thereto toward the rails and into engagement with a portion of the article to straighten, the arms defining a second space therebetween; (c) moving the actuator with the pair of arms away from the article disposed on the rails; and (d) removing the article from the rails. The steps of (a)-(c) can be repeated one or more times at the same or a different portion of the article prior to performing step (d).

The objects, features and advantages of the apparatus and method will be readily apparent to those skilled in the art upon a reading of the description of preferred embodiments which follows when taken in conjunction with the accompanying drawings.

DETAILED DESCRIPTION

Figure 1A:
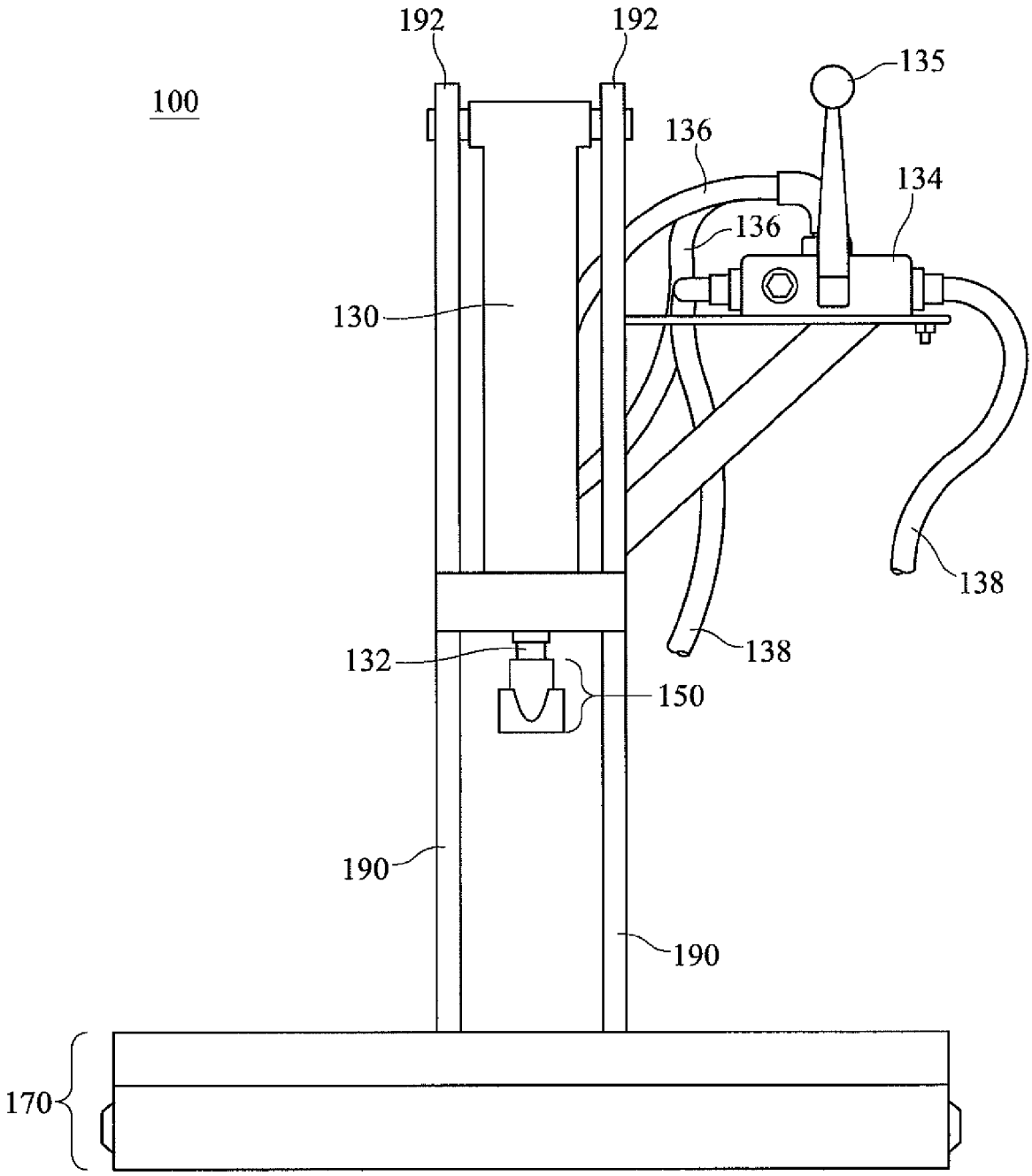
FIG. 1A is a front view of the apparatus.
Figure 1B:
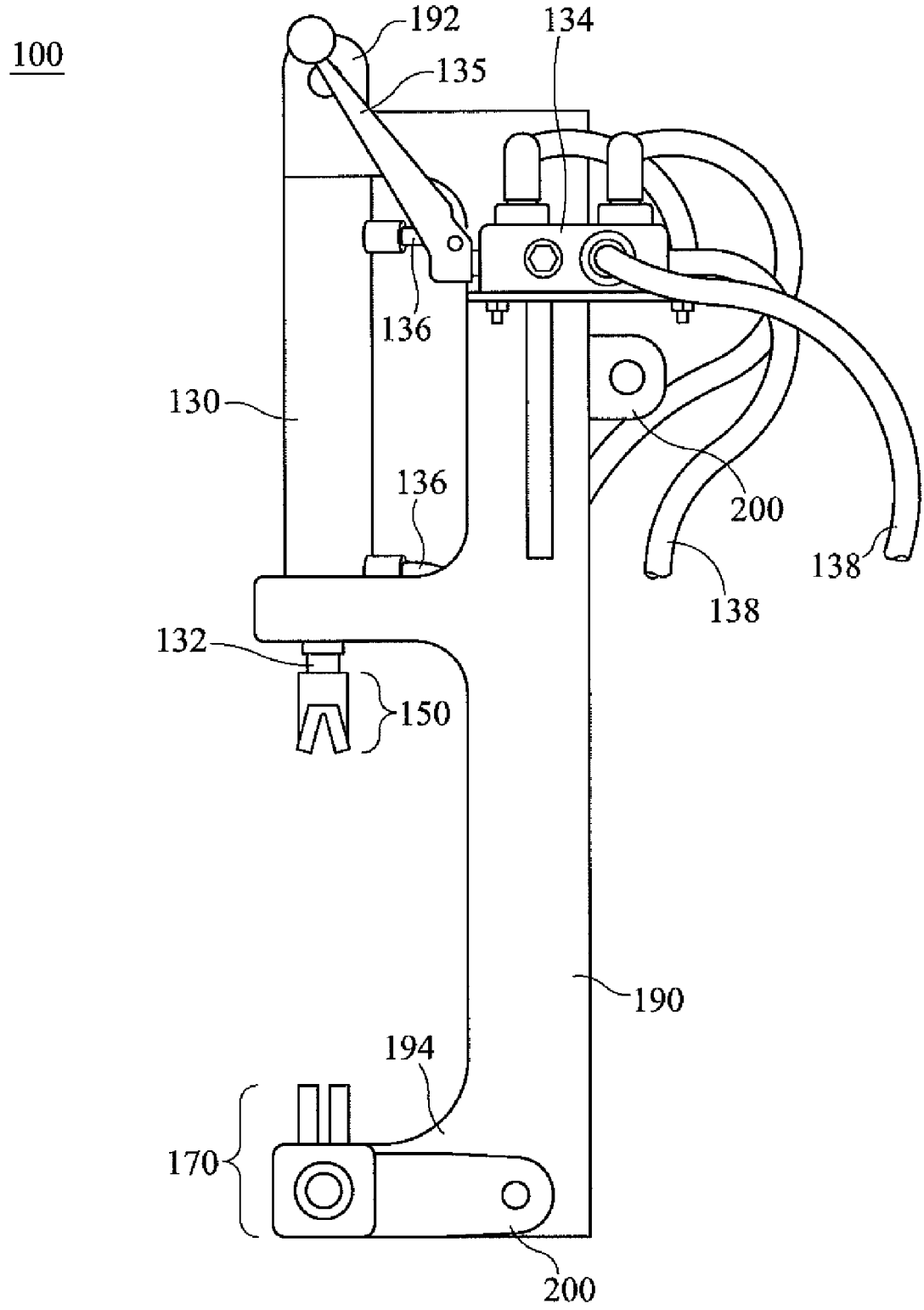
FIG. 1B is a side view of the apparatus.
Figure 1C:
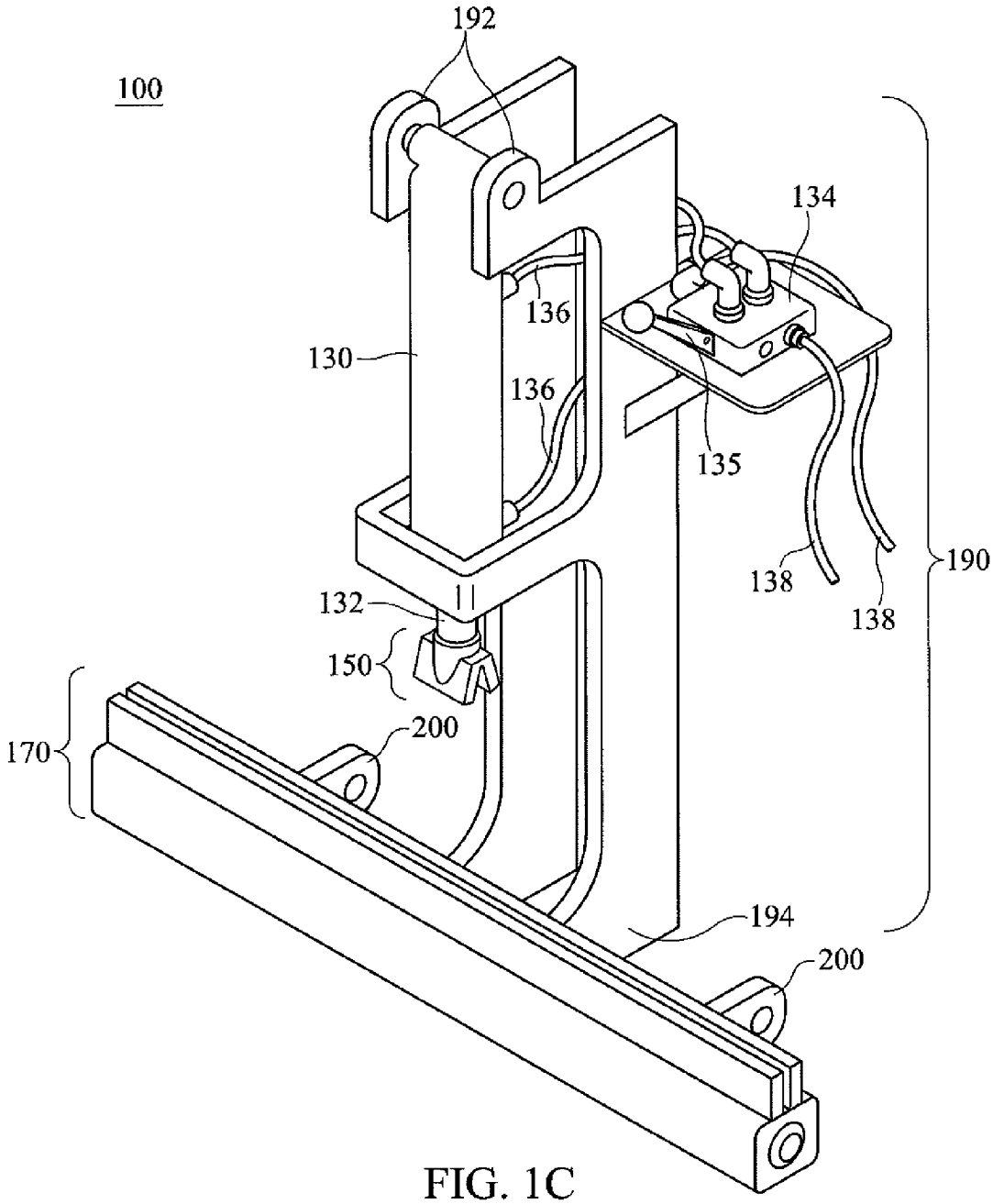
FIG. 1C is a perspective view of the apparatus.
Figure 3A:
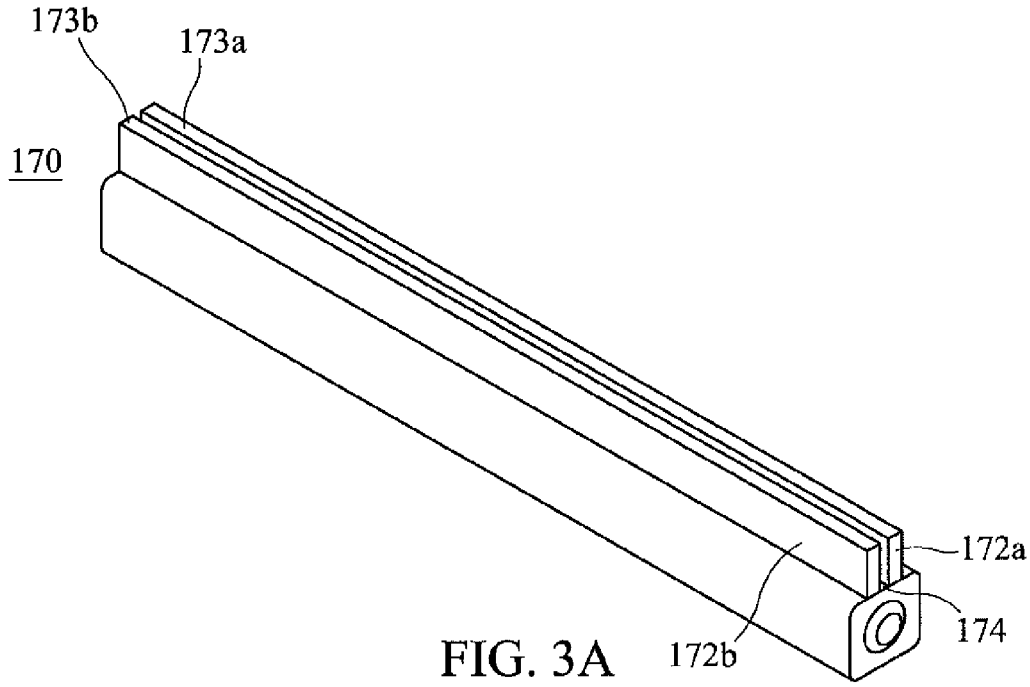
FIG. 3A is a perspective view of one embodiment of the support member.
Figure 3B:
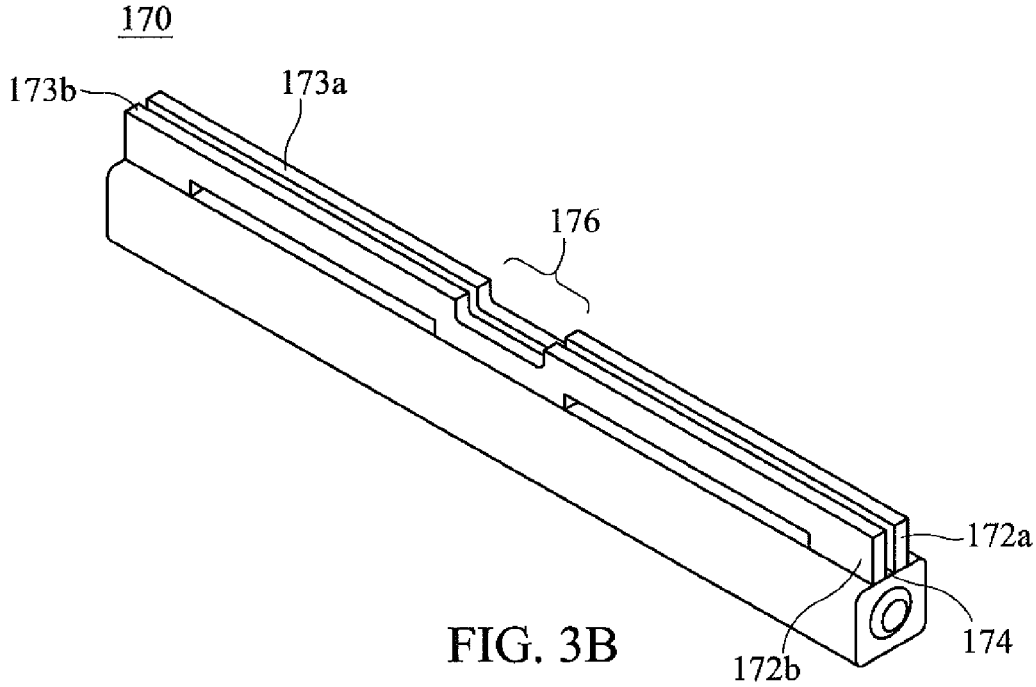
FIG. 3B is a perspective view of another embodiment of the support member.
Figure 3C:
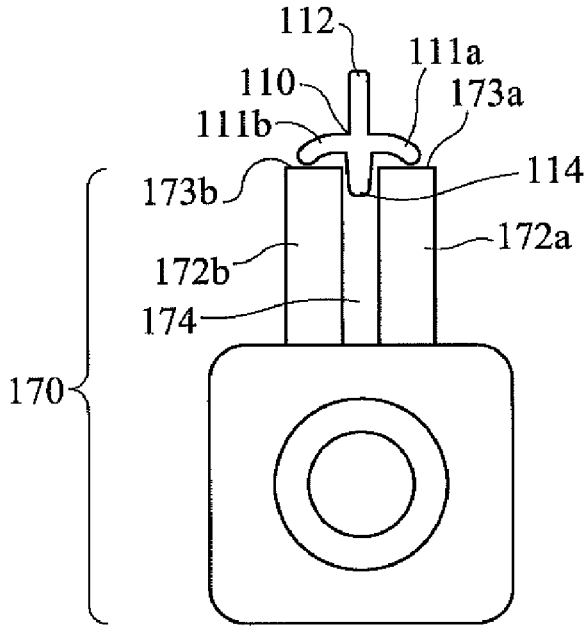
FIG. 3C is a side view of one embodiment of an article disposed on the support member.
Figure 3D:
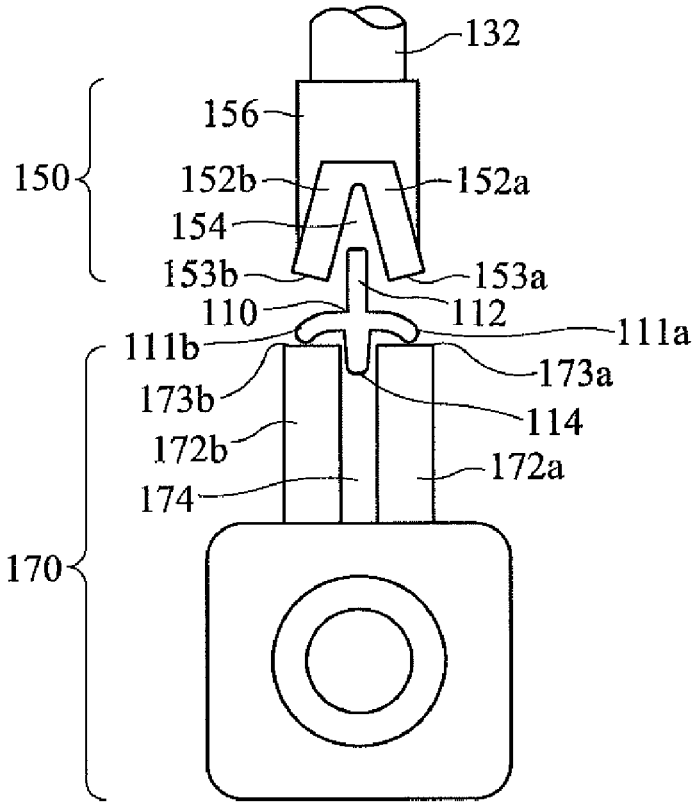
FIG. 3D is a side view of one embodiment illustrating engagement of an article disposed on the support member by an endpiece.

In one embodiment, an apparatus for straightening an article is provided. As depicted in FIG. 1C, apparatus 100 comprises actuator 130, endpiece 150, support member 170, and elongated frame member 190. Upon activation of actuator 130, endpiece 150 moves toward and engages an article that is located on support 170. One advantage of apparatus 100 is that it permits selective straightening of articles such that some portions may be engaged by endpiece 150 while other portions are avoided. For example, as depicted in FIGS. 3C and 3D, article 110 may contain portions 112 and 114 that need to be avoided during the straightening process, whereas portions 111*a* and 111*b* require straightening. Endpiece 150 and support member 170 are adapted to straighten article 110 based on features described in the embodiments that follow.

Figure 2A:
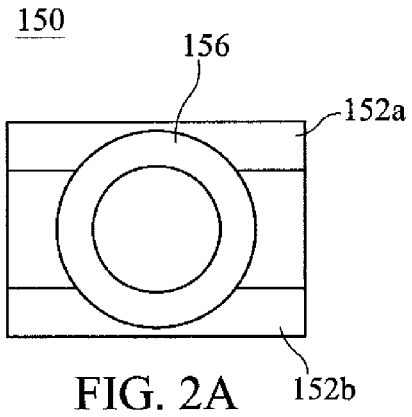
FIG. 2A is a top view of one embodiment of the endpiece.
Figure 2B:
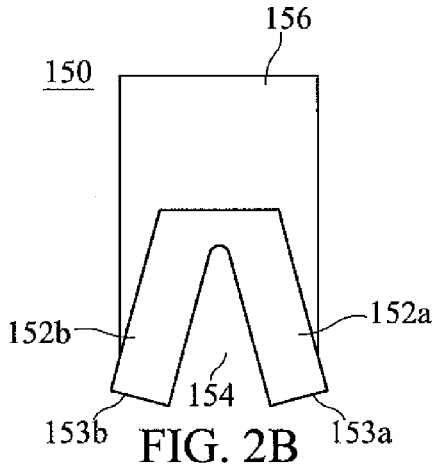
FIG. 2B is a side view of one embodiment of the endpiece.
Figure 2C:
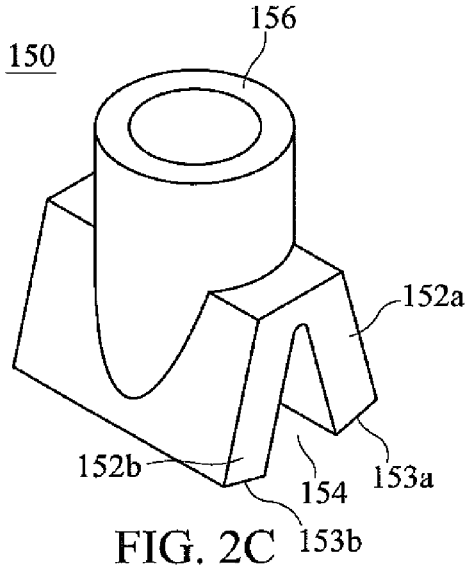
FIG. 2C is a perspective view of one embodiment of the endpiece.
Figure 2D:
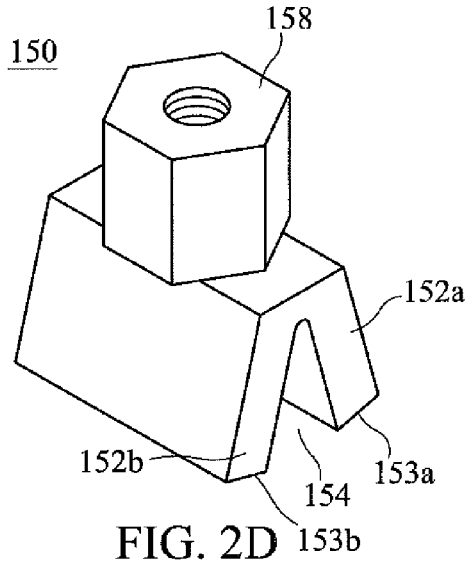
FIG. 2D is a perspective view of another embodiment of the endpiece.

One embodiment of endpiece 150 is depicted in FIGS. 2A, 2B, and 2C. In this embodiment, endpiece 150 includes arms 152*a*, 152*b*, where arms 152*a*, 152*b* define space 154. Arms 152*a*, 152*b* define arm contact surfaces 153*a*, 153*b* for selectively engaging article portions. Endpiece 150 further includes base portion 156 from which arms 152*a*, 152*b* extend. Base portion 156 provides a site of attachment to actuator 130. The attachment of endpiece 150 to actuator 130 can be permanent or temporary, via weld, adhesive, pins, or threadably secured, etc. FIG. 2D depicts another embodiment of endpiece 150. In this embodiment, base 158, which has internal threading, can be for example, but not by way of limitation, a nut. One end of actuator 130, for example extendable portion 132, is threaded to allow attachment to endpiece 150.

In one aspect of this embodiment, arms 152*a*, 152*b* are arranged to form a generally inverted V-shape as depicted in the figures. Arms 152*a*, 152*b* define the generally inverted V-shape by serving as the sides which meet at an apex as depicted in FIGS. 1B, 1C, 2B, 2C, 2D, and 3D. In effect, space 154, defined by arms 152*a*, 152*b* can have some degree of contour as arrangement of arms 152*a*, 152*b* is varied but still generally has the appearance of an inverted letter "V." In another embodiment, not depicted in any of the figures, arms 152*a*, 152*b* are arranged such that arm contact surfaces 153*a*, 153*b* are parallel to each other. In this embodiment arms 152*a*, 152*b* do not converge at an apex, rather arms 152*a*, 152*b* are parallel and the general shape can be thought of as generally rectangular in shape but without a fourth side. In one embodiment, arms 152*a*, 152*b* have a length of 8.89 cm (3.5 in), a width of 1.27 cm (0.5 in), and a height of 3.81 cm (1.5 in).

In one aspect, apparatus 100 includes a support member 170. Support member 170 is coupled to elongated frame member 190 at lower end 194 of elongated frame member 190 as illustrated in FIGS. 1A, 1B, and 1C. FIGS. 3A and 3B depict two embodiments of support member 170. In FIG. 3A, support member 170 includes two rails 172*a*, 172*b* and space 174 defined between rails 172*a*, 172*b*. Rails 172*a*, 172*b* define rail contact surfaces 173*a*, 173*b*, respectively, for supporting article 110 as shown in FIGS. 3C and 3D. In FIG. 3B, support member 170 also includes gap 176.

Rails 172*a*, 172*b* are arranged such that rail contact surfaces 173*a*, 173*b* are parallel to each other. The distance between rail contact surfaces 173*a*, 173*b* is substantially similar to the distance between arm contact surfaces 153*a*, 153*b* such that arm contact surfaces 153*a*, 153*b* are aligned with rail contact surfaces 173*a*, 173*b*. In this embodiment, "aligned" does not require the arm contact surfaces 153*a*, 153*b* to be parallel to the rail contact surfaces 173*a*, 173*b*, but instead, the surfaces are sufficiently aligned as long as the arm contact surfaces 153*a*, 153*b* will contact article portions disposed on the rail contact surfaces 173*a*, 173*b* upon activation of the actuator. For example, in one embodiment, the distance between rail contact surfaces 173*a*, 173*b* is approximately 1.27 cm (0.5 in) and the distance between arm contact surfaces 153*a*, 153*b* is approximately 1.27 cm (0.5 in). In another embodiment, rails 172*a*, 172*b* of support member 170 have a length of about 101.6 cm (40 in), a width of about 1.27 cm (0.5 in), and a height of about 6.35 cm (2.5 in).

Arms 152*a*, 152*b* are arranged to allow the force exerted upon an article 110 to be applied evenly on engaged article portions 111*a*, 111*b* while avoiding contact with proximal portions, such as 112, 114 within spaces 154, 174, respectively. Arms 152*a*, 152*b* are arranged such that arm contact surfaces 153*a*, 153*b* engage article portions 111*a*, 111*b* of article 110 disposed on rails 172*a*, 172*b*. As previously discussed, the distance between rail contact surfaces 173*a*, 173*b* is substantially similar to the distance between arm contact surfaces 153*a*, 153*b* such that arm contact surfaces 153*a*, 153*b* are aligned with or overlie rail contact surfaces 173*a*, 173*b* for engaging article 110. It should be appreciated that arms 152*a*, 152*b* and rails 172*a*, 172*b* may be adapted and modified to accommodate the shape and dimensions of the article to be straightened.

FIG. 3B depicts another embodiment of support member 170 where rail contact surfaces 173*a*, 173*b* contain gap 176. In this embodiment, article portions 111*a*, 111*b* which are engaged by arms 152*a*, 152*b* are not disposed on rails 172*a*, 172*b* and thus article portions 111*a*, 111*b* overlying gap 176 are not in contact with rail contact surfaces 173*a*, 173*b* when engaged by arms 152*a*, 152*b*. Gap 176 in rail contact surfaces 173*a*, 173*b* helps reduce the potential for cracking or breaking article 110 during the straightening process. When article 110 is engaged by endpiece 150, article 110 is permitted to slightly bend, flex, or deform into gap area 176. Once the force (or stress) is no longer applied, the article 110 returns to the starting position within gap area 176 with the portion of article 110 overlying gap 176 straightened.

In one embodiment, the endpiece 150 is caused to engage an article on the support member 170 through activation of an actuator 130. Actuator 130 can be anything that converts a source of energy into some kind of motion capable of producing a force. For example actuator 130 could be a hydraulic cylinder, a pneumatic or air cylinder, a vertical ram, or any other device known in the art capable of applying a sufficient force required to straighten article portions 111*a*, 111*b* disposed on support member 170, as depicted in FIG. 3D without cracking or breaking article 110. For example, but not by way of limitation, actuator 130 can exert a force of approximately 20.7 MPa (3,000 psi) to straighten article 110.

In one embodiment, actuator 130 is a double acting cylinder. Movement of actuator 130 is controlled by actuator valve 134 via lever 135 and lines 136 and 138 in a manner known to those skilled in the art. Lines 138 are connected to a reservoir not depicted in the drawings but known to those skilled in the art.

In one arrangement, actuator 130 and support member 170 are coupled to opposite ends of elongated frame member 190. As depicted in FIG. 1C, elongated frame member 190 has upper end 192 and lower end 194 providing attachments sites for the actuator 130 and support member 170, respectively. Actuator 130 and support member 170 are arranged on the elongated frame member 190 such that space 154 between arms 152*a* and 152*b* is aligned with space 174 defined by rails 172*a* and 172*b*. For example, when endpiece 150 is moved toward support member 170, space 154 will overlie space 174, likewise arm contact surfaces 153*a*, 153*b* will overlie rail contact surfaces 173*a*, 173*b*.

Activation or engagement of actuator 130 causes endpiece 150 to move toward or be lowered to support member 170 thereby permitting arms 152*a*, 152*b* to engage article 110. Likewise, retracting or moving actuator 130 and endpiece 150 away from article 110 disposed on rails 172*a*, 172*b* ceases such engagement. In one embodiment, endpiece 150 is coupled to extendable portion 132 that is on one end of actuator 130. Activation of actuator 130 causes extendable portion 132 and endpiece 150 to move toward support member 170. Extendable portion 132 and endpiece 150 can be secured to each other by any means known in the art, for example, pins, weld, adhesive, clips, or threadable attachment, etc. In one embodiment, one end of actuator 130, for example extendable portion 132, is threaded to permit attachment with endpiece 150. The coupling between actuator 130 and endpiece 150 can be permanent or temporary.

Article 110 as depicted in FIGS. 3C and 3D illustrates one embodiment as to how article 110 may be positioned with respect to support member 170 and endpiece 150. In FIGS. 3C and 3D, bent portions 111*a*, 111*b* are disposed on rails 172*a*, 172*b* and are in contact with rail contact surfaces 173*a*, 173*b*. First space 174 is adapted to receive article portion 114, which is proximal to portions 111*a*, 111*b* as shown in FIGS. 3C and 3D. For example, when article 110 is engaged by arms 152*a*, 152*b* portion 114 in space 174 is not engaged. Likewise, second space 154 is adapted to receive article portion 112. Thus, when article 110 is engaged by arms 152*a*, 152*b*, portion 112 in space 154 is not engaged by endpiece 150.

It should be appreciated that the configuration of article 110 is not limited to that depicted in FIGS. 3C and 3D. For example, article 110 can be arranged in such a way that article portion 112 and 114 are in contact with rails 172*a*, 172*b* and article portion 111*a* is positioned in space 174. In another arrangement, article 110 can be positioned such that only article portion 112 is in contact with rail contact surface 173*a* of rail 172*a* and no remaining portions of the article 110 are disposed in space 174. In one aspect, article 110 is a t-post; however, article 110 can be any metal or alloy post, such as posts typically used for street signs, i.e., U-channel posts; or any article that can be disposed on rails 172*a*, 172*b* regardless of having portions, such as 112, 114 which can be received by spaces 154, 174.

One advantage of apparatus 100 is that it is portable. In one embodiment, apparatus 100 may be attached, for example, to the three-point hitch on a tractor utilizing attachment portions 200. Additionally, apparatus 100 may be transported on a flat bed vehicle or towed for use on-site, for example when a property owner travels along a fence line for inspection and repair.

For example, in farming operations, the power required to operate actuator 130 can come from using the hydraulics and/or electrical source of a tractor or the bale spike hydraulics of a truck. Additionally, actuator 130 may be operably connected to an air compressor.

For example, apparatus 100 may be adapted as a self-contained unit for use with a 4-wheeler or off-road vehicle, such as an all-terrain vehicle (ATV). In such an arrangement, provisions are made for attachment or towing of apparatus 100 to the vehicle, as well having a self-contained reservoir and movable power source. The power source could also be the battery of the ATV in addition to a separate movable power source. It should be appreciated that a self-contained movable reservoir may be used in the embodiments described herein.

Although the figures depict elongated frame member 190 as oriented vertically, it should be appreciated that apparatus 100 may be oriented and operated horizontally provided provisions are made, for example, by adjusting location of attachment portions 200.

A method for straightening article 110 is disclosed. The method comprises placing article 110 on rails 172*a*, 172*b* and moving actuator 130 having arms 152*a*, 152*b* connected thereto toward rails 172*a*, 172*b* and into engagement with portions 111*a*, 111*b* of article 110 to straighten. First space 174 is defined between rails 172*a*, 172*b* and second space 154 is defined between arms 152*a*, 152*b*. First and second spaces, 174 and 154 are adapted to receive article portions 114, 112, respectively. The method also includes moving actuator 130 with arms 152*a*, 152*b* away from article 110 disposed on rails 172*a*, 172*b*. As previously discussed above, engaging and retracting actuator 130 are well known to those skilled in the art. In one embodiment, activating or engaging and retracting actuator 130 is performed by operating lever 135 operably coupled to actuator 130. The method also includes removing article 110 from rails 172*a*, 172*b*.

It should be appreciated that the steps of placing article 110 on rails 172*a*, 172*b*, and moving actuator 130 toward and away from article 110 can be repeated one or more times at the same portions of article 110 or at different portions along article 110 prior to removing article 110 from rails 172*a*, 172*b*.

Thus, the present invention is well adapted to carry out the objects and attain the ends and advantages mentioned above as well as those inherent therein. While certain embodiments of the invention have been described for the purpose of this disclosure, numerous changes in the construction and arrangement of parts and the performance of steps can be made by those skilled in the art, which changes are encompassed within the scope and spirit of this invention defined by the appended claims.

What is claimed is:

1. An apparatus for recycling a deformed article comprising:

an actuator;

an endpiece coupled to the actuator, the endpiece comprising two arms, each arm defining a contact surface for contacting the deformed article, wherein a first space is defined between the arms thereby permitting portions of the deformed article to avoid contact by the endpiece, wherein said first space defines a first width between the arm contact surfaces; and a support member comprising a pair of rails having a second space therebetween, wherein said second space defines a second width, wherein the first width and the second width are substantially similar, said rails each defined by two longitudinally aligned support surfaces separated by a gap, wherein upon activation of the actuator, the arm contact surfaces engage portions of the deformed article that are overlying the gaps, wherein the arm contact surfaces do not engage portions of the deformed article received in the first and second spaces.

2. The apparatus of claim 1, further comprising an elongated frame member wherein the actuator is coupled to an upper end and the support member is coupled to a lower end of the elongated frame member.

3. The apparatus of claim 1, wherein the aim contact surfaces are parallel.

4. The apparatus of claim 1, wherein the endpiece comprises a base portion and the arms extend from the base portion.

5. The apparatus of claim 4, wherein the base portion has internal threading and one end of the actuator is threaded to allow attachment to the endpiece.

6. The apparatus of claim 1, wherein the article is a t-post.

7. The apparatus of claim 1, wherein the arms define a first length and the gap in the rail support surfaces define a second length, wherein the first and second lengths are substantially similar.

8. An apparatus for straightening an article comprising:

an actuator;

an endpiece coupled to the actuator, the endpiece comprising two arms, the arms defining a first space therebetween, wherein the arms define arm contact surfaces for contacting an article to be straightened;

a support member comprising two rails, the rails defining a second space therebetween, wherein the rails define rail support surfaces for supporting the article, and wherein each rail support surface includes a gap, wherein an article portion overlying the gap is not contacted by the rail support surfaces and wherein the article portion overlying the gap is engaged by the arms; and an elongated frame member, wherein the actuator and the support member are coupled to the frame member and arranged such that the arm contact surfaces are aligned with the rail support surfaces;

wherein upon activation of the actuator, the actuator moves toward the support member causing the arms to engage the article, and wherein the first and second spaces are adapted to receive article portions such that article portions within the first and second spaces are not engaged, wherein article portions within the first space avoid contact with the endpiece and article portions within the second space avoid contact with the support member.

9. The apparatus of claim 8, wherein the arms define a first length and the gap in the rail support surfaces defines a second length, wherein the first and second lengths are substantially similar.

* * * * *